United States Patent [19]

Lahti

[11] Patent Number: 4,457,492

[45] Date of Patent: Jul. 3, 1984

[54] LIFTING APPARATUS

[76] Inventor: Terry L. Lahti, Rte. 1, Box 98, Houghton, Mich. 49931

[21] Appl. No.: 420,582

[22] Filed: Sep. 20, 1982

[51] Int. Cl.[3] ..... B66F 3/00

[52] U.S. Cl. ..... 254/8 B; 254/114; 74/107

[58] Field of Search ..... 254/114, 8 B, 8 C, 9 B, 254/9 C, 2 B, 2 C, 131; 269/232, 236; 74/569, 107

[56] References Cited

U.S. PATENT DOCUMENTS

| | | | |
|---|---|---|---|
| 126,286 | 4/1872 | Greenwalt | 254/114 |
| 242,863 | 6/1881 | Bates | 254/114 |
| 278,594 | 5/1883 | Petticrew | 254/114 |
| 1,425,542 | 8/1922 | Raymond et al. | 254/114 |
| 1,602,275 | 10/1926 | Longstreth | 254/114 |
| 1,858,021 | 5/1932 | Marshall | 254/114 |
| 2,081,390 | 5/1937 | Trapp | 74/569 |
| 2,655,412 | 10/1953 | Jones | 254/2 C |
| 4,248,405 | 2/1981 | Kameda | 254/10 B |

*Primary Examiner*—Robert C. Watson

*Attorney, Agent, or Firm*—Michael L. Bauchan

[57] ABSTRACT

A lifting apparatus for lifting a load such as a motorcycle. The apparatus includes a base and a load support which may be placed under the load to be lifted. The base and load support each include vertical columns, one column being positioned in the other column so that the columns telescope to raise and lower the load support. A lever operable cam is secured to the base at a pivot having a horizontal axis and the cam surface is in contact with a cam follower secured to the load support. The lever pivots the cam so as to raise and lower the load support. The cam surface configuration keeps the load support in either the raised or lower position until the lever is operated.

6 Claims, 5 Drawing Figures

LIFTING APPARATUS

BACKGROUND OF THE INVENTION

This invention relates to unique lifting apparatus and in particular to apparatus for lifting a motorcycle.

Many objects positioned on a surface such as the ground or the floor of a building have to be lifted off such a surface. Some objects such as these have a suitable lift point which is already above such a surface. For example, conventional motorcycles generally have two wheels connected by a frame assembly on which an engine is positioned and at which is located the center of gravity of the motorcycle. Accordingly, to service motorcycles it is frequently necessary to support the motorcycle on its engine and frame.

Efforts have been made by some persons to develop suitable motorcycle support apparatus. For example, Hartman, Jr. U.S. Pat. No. 4,113,235 and Ivers et al U.S. Pat. No. 4,1080,253 are two U.S. patents describing apparatus for use in lifting and supporting motorcycles for service. Richards U.S. Pat. No. 3,907,254 is another U.S. patent which discloses lifting apparatus for lifting a load such as a snowmobile.

At present none of the aforementioned lifting apparatus nor any other type of lifting apparatus has gained wide acceptance for use in lifting and supporting motorcycles either on the ground or on the floor of a building. To fully service a motorcycle it is desirable that both motorcycle wheels be simultaneously lifted off the surface on which it is located and that the lifting apparatus not obstruct servicing the motorcycle wheels or any other functional part of the motorcycle. This is not possible with the apparatus described in the aforementioned patents. It is believed that this is the reason that the generally accepted method of supporting a motorcycle while servicing it is to support the motorcycle engine and frame on a sturdy crate of a suitable height. One person generally lifts one end of the motorcycle while another person places the crate beneath the engine and frame at a point where the motorcycle will balance on the crate when the lifted end is lowered.

SUMMARY OF THE INVENTION

This invention relates to unique lifting apparatus for lifting a load, such as a motorcycle. The apparatus includes a base and a load support which may be placed under the load to be lifted. The base and load support each include vertical columns, one column being positioned in the other column so that the columns telescope to raise and lower the load support. A lever operable cam is secured to the base at a pivot having a horizontal axis and the cam surface is in contact with a cam follower secured to the load support. The lever pivots the cam so as to raise and lower the load support. The cam surface configuration keeps the load support in either the raised or lower position until the lever is operated.

Even though this apparatus is particularly designed for lifting and supporting motorcycles it may be utilized for lifting other loads.

It is an object of this invention to provide lifting apparatus utilizing a cam and cam follower to transmit a lifting force to a load support which moves translationally relative to a base.

It is a further object of this invention to provide lifting apparatus which utilizes a lever operated cam and cam follower for translational movement of a load support relative to a base and which utilizes a cam configuration that causes the weight of the load support and any load which it supports to hold the load in a raised position.

It is a further object of this invention to provide a lever actuated cam and cam follower to impart translational movement of a load support relative to a base and which utilizes the weight of the load support and any load which it supports to hold such a load in a raised position and which utilizes a handle in the shape of a stirrup attached to the cam with a link parallelogram so as to permit raising the load support by stepping on the stirrup.

BRIEF DESCRIPTION OF THE DRAWINGS

The foregoing and other objects and advantages of this invention will be evidenced from the following description and the accompanying drawings in which.

DESCRIPTION OF THE PREFERRED EMBODIMENTS

Before explaining the present invention in detail, it is to be understood that this invention is not limited in its application to the details of construction and arrangement of parts illustrated in the accompaning drawings or described in this description as the subject apparatus may be practiced in other embodiments.

It is further to be understood that the terminology employed in this description is utilized to teach persons skilled in the art and is not intended to be limiting as to the embodiments in which the invention may be practiced. While it is preferred that substantially all of the components of the embodiments described here be made of steel persons skilled in the art will appreciate that aluminum and various other materials may be employed in building the subject apparatus.

Figure 1:
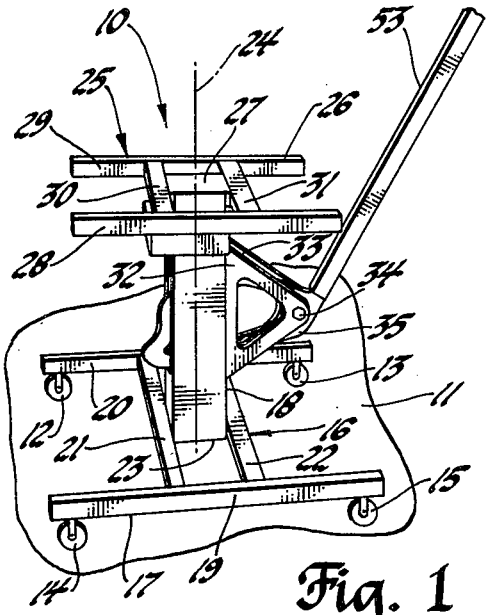
FIG. 1 is a prospective view of lifting apparatus embodying the principals of the subject invention in a lowered position.
Figure 2:
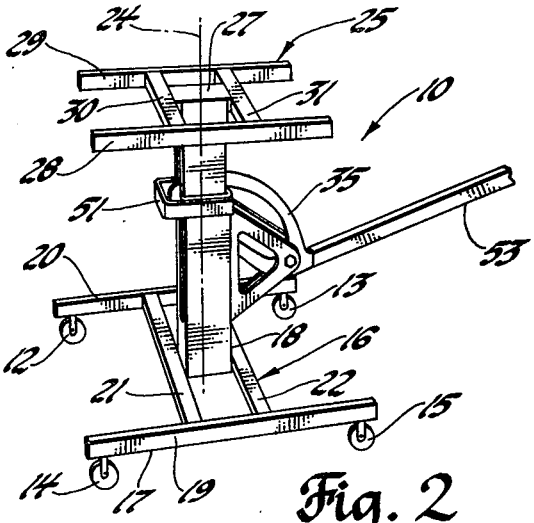
FIG. 2 is a prospective view of the apparatus in FIG. 1 in a raised position.

In FIG. 1 lifting apparatus 10 is illustrated embodying the principals of the subject invention. The apparatus 10 is in the form of a stand which may be used for raising, lowering, supporting, and moving a suitable load such as a motorcycle on a surface 11, which may be either a place on the ground or a relatively smooth concrete surface in the form of a building floor. If the apparatus 10 is used on a concrete building floor it may include removable casters 12–15 so the motorcycle supported by the apparatus 10 may be transported on the surface 11 by rolling the casters 12–15, which may be of any conventional design and preferably are pivoted to permit rolling in any direction. If the surface 11 is ground on which the casters 12–15 can not be used the casters 12–15 would be removed from the apparatus 10.

In addition to the casters 12–15 the apparatus 10 in FIG. 1 includes a base member 16 which includes a platform 17 in the general form of an "H" and a substantially vertical base column 18. The platform 17 is designed to be strong and a stable foundation on which to support a motorcycle while being of a relatively light weight. The platform 17 in the illustrated embodiment includes four steel tubes 19–22 which in the preferred embodiment are welded together. The casters 12–15 are pivotally mounted on the bottom of the tubes 19–20 at their respective ends. The bottom end 23 of base column 18 is welded to tubes 21–22 so the base column 18 is substantially defined by a vertical axis 24.

The base member 16 supports a load support assembly 25 that includes a load support 26 and a load support column 27 that is also substantially defined by the vertical axis 24. The load support 26 includes tubes 28–31 that are substantially in an "H" configuration welded to each other and to the load support column 27 so as to provide a large platform on which to support and balance a relatively large load such as a motorcycle frame and engine.

Figure 3:
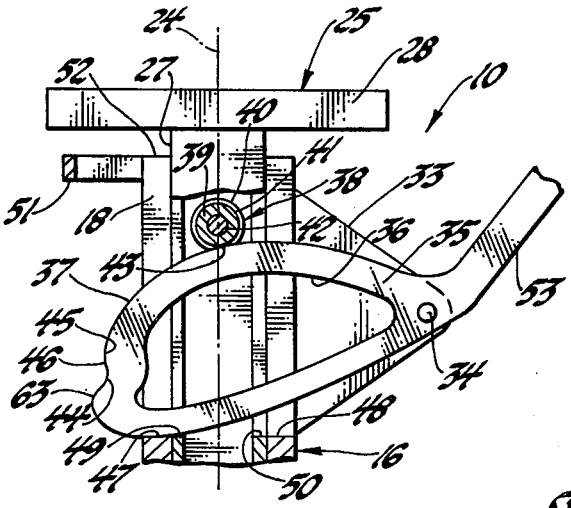
FIG. 3 is a partial sectional view of the apparatus in FIG. 1 in a lowered position.

In the illustrated embodiment the base column 18 and the load support column 27 each have a rectangular cross section configuration and are tubular. The outside dimensions of load support column 27 are slightly smaller than the inside dimensions of base column 18. As shown in FIG. 3 load support column 27 is positioned inside base column 18 and they are both substantially defined by the vertical axis 24. By having one column 27 inside the other column 18 the base column 18 and load support column 27 together form a telescopic column which connects base member 16 to the load support assembly 25. Base column 18 guides load support column 27 so as to substantially prevent any relative movement between load support assembly 25 and base member 16 except for translational movement substantially in the direction of the vertical axis 24 on which they are both aligned.

The base member 16 also includes triangular shaped brackets 32 and 33 connected by a cylindrical pin 34 which is defined by a substantially horizontal axis.

A cam 35 is pivotally attached to the base member 16 by the pin 34. A hole 36 is provided in the cam 35 to save weight without substantially affecting the strength of the cam 35, which in the preferred embodiment is made of steel approximately ½ inch thick. The cam 35 includes a cam surface 37. A cam follower 38 is secured to the load support assembly 25. In the preferred embodiment illustrated inn FIG. 3 the cam follower 38 is a pulley 39 having a peripheral rim 40 in which an annular grove 41 is formed. The pulley 39 is pivoted on a pin 42 which is substantially defined by a horizontal axis parallel to the axis of pin 34. The width of the annular grove 41 in the preferred embodiment is slightly wider than the width of the cam 35 which as aforementioned in the preferred embodiment is a half inch.

The total length of the telescopic column formed by the upper and lower columns, being the load support column 27 and the base column 18, determines the height of the load support 26 above the surface 11. The length of this telescoping column is determined by the position of the cam follower 38 above the surface 11 with the cam follower 38 position being determined by the angular position of the cam 35 relative to the pin 34 at which the cam 35 is pivotally connected to the base member 16.

Figure 4:
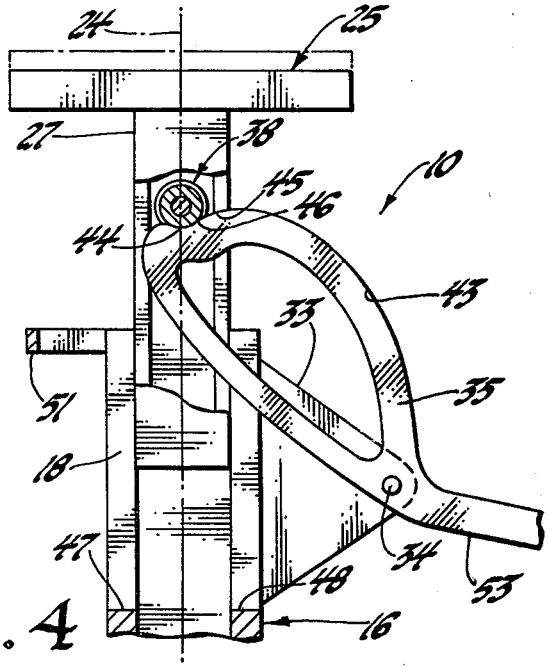
FIG. 4 is a partial sectional view of the apparatus in FIG. 2 in a raised position.

As shown in FIGS. 3 and 4 the cam follower 38 is pivotally attached to the load support column 27 by pin 42 so as to permit the cam follower 38 rolling along cam surface 37 from a first cam surface point 43 to a second cam surface point 44. For reasons which will soon become apparent a third cam surface point 45 is also indicated in FIGS. 3–4.

When the cam 35 is in the position shown in FIG. 3 the cam follower 38 contacts the cam surface 37 at the first cam surface point 43. The cam follower 38 in FIG. 3 is at its lowest position relative to the surface 11. If the cam 35 is angularly rotated so as to pivot about cam 34 the cam surface 37 is moved past the cam follower 38, which rolls along the cam surface 37 as the cam 35 is pivoted clockwise about its pivot at pin 34 as shown in FIG. 3.

When the cam 35 is rotated clockwise in a first direction about pin 34 to the point where the cam follower 38 contacts the third cam surface point 45 the load support assembly 25 is at its highest point as illustrated in phantom lines in FIG. 4. Further clockwise rotation of the cam 35 causes the cam follower 38 to roll down an inclined surface 46 in the cam surface 37 between the second cam surface point 44 and the third cam surface point 45. The inclined surface 46 is oriented relative to the pivot at pin 34 so as to permit the cam follower 38 to be lowered toward the surface 11 as shown in solid lines in FIG. 4 as the cam follower 38 goes from the third cam surface point 45 to the second cam surface point 44.

The weight of the load support assembly 25 and any load which it supports is transmitted through the cam follower 38 to the cam surface 37. Accordingly, when the cam follower 38 contacts the cam surface 37 at a point between the cam surface second and third points 44 and 45 horizontal and vertical components of this force exist. The vertical component is parallel to the vertical axis 24 while the horizontal component of this force against the inclined surface 46 of the cam surface 37 produces a turning moment against the inclined surface 46 tending to pivot cam 35 clockwise in the first direction around the pivot at pin 34. It is thus apparent that when the cam follower 38 contacts the cam surface 37 between the third cam surface point 45 and the second cam surface point 44 the weight of the load support assembly 25 and any load which it supports provides a force which holds the load support assembly 25 in the intermediate position illustrated in FIG. 4 in solid lines.

To lower the load support assembly 25 from the intermediate position of surface 11 shown in solid lines in FIG. 4 it is necessary to pivot the cam 35 in a second direction that is counter-clockwise about the pin 34 as illustrated in FIGS. 3 and 4. Pivoting the cam 35 counter-clockwise rolls the cam follower 38 up the inclined surface 46 of the cam surface 37 and raises the load support assembly 25 to its highest position above the surface 11 as illustrated in the phantom lines in FIG. 4. Pivoting the cam 35 counter-clockwise further causes the cam follower 38 to roll back on the cam surface 37 from second cam surface point 44 to first cam surface point 43 so as to lower the load support assembly 25 to its lowest position as illustrated in FIG. 3.

When the cam 35 is in the position illustrated in FIG. 3 it extends through both the base column 18 and the load support column 27. Accordingly, vertical notches 47–48 having a width wider than the width of the cam 35 are formed in opposite walls of the base column 18 and notches 49–50 of substantially the same width as the notches 47–48 are formed in the load support column 27 with all four notches 47–50 substantially aligned on a horizontal axis so the cam 35 may freely pivot about pin 34 without being obstructed by either base column 18 of load support column 27. Additional rigidity is provided base column 18 by a "U" shaped bracket 51 being welded to opposite sides of base column 18 which to not contain any of the notches 47–50.

In FIG. 3 the bottom of the cam 35 is illustrated as resting on the bottom of notch 47 in base column 18, thereby limiting the vertical movement of cam follower 38 along the vertical axis 24. Persons versed in the art will appreciate that the notches 47–50 could easily be extended closer to the surface 11, in which case the cam follower 38 would continue to move along the cam surface 37 until the load support assembly 25 abuts the free top end 52 of the base column 18. This is illustrated in phantom lines in FIG. 5. It is to be understood if additional vertical movement of the cam follower 38 along the vertical axis 24 is permitted until the load support assembly 25 abuts the top end 52 of the base column 18 the first cam surface point 43 would be at the point where the cam follower 38 contacts the cam surface 37 when it is in its lowest position, which would be closer to the pivot 34 than the location where the first cam surface point 43 is illustrated in FIGS. 3–4.

Figure 5:
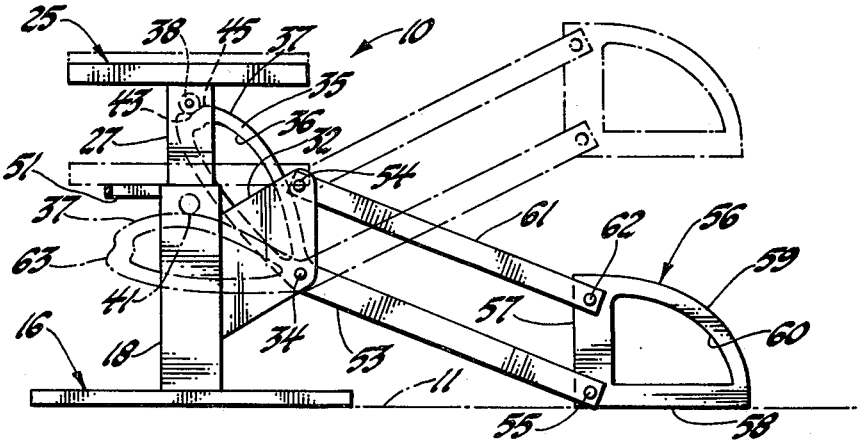
FIG. 5 is a prospective view of an alternative embodiment of the apparatus in FIG. 1 utilizing a different actuation mechanism.

A lever 53 is welded to the cam 35 in FIGS. 1–4 to facilitate pivoting cam 35 in said first and second directions clockwise and counter-clockwise, respectively, about pin 34. In FIG. 5 a more sophisticated actuated mechanism is provided in place of the lever 53 being the only actuactor.

In FIG. 5 the brackets 32–33 have been modified to provide a second pivot where a pin 54 connects the brackets 32 and 33. Pin 54 is defined by a horizontal axis parallel to the axis which defines pin 34 and is located directly above pin 34. In FIG. 5 the lever 53 is a first link in a parallelogram and is pivotally connected at a pin 55 to a handle 56 that includes a vertical arm 57, a horizontal lower arm 58 and an upper arm 59. The handle 56 is thus in the form of a stirrup with a space 60 between the lower arm 58 and upper arm 59 of a sufficient size for insertion of a human foot. A second link 61 is pivotally connected at the pin 54 to the brackets 32–33 at one end and the other end of the second link 61 is pivotally connected to the vertical arm 57 of the handle 56 by a pin 62. A parallelogram defined by a vertical plane is thus formed in which a first link consisting of lever 53 is parallel to the second link 61 and opposite from it and they are connected at opposite ends by the brackets 32–33 and the vertical arm 57 of the handle 56.

The operation of the apparatus 10 in FIG. 5 is similar to the operation of the apparatus in FIGS. 1–4. When the handle 56 is in its upper-most position illustrated in phantom lines in FIG. 5 the lower arm 58 is horizontal and the load support assembly 25 rests on the top of base column 18. The cam follower 38 is in a first position relative to the surface 11 corresponding to cam follower 38 being in contact with the first cam surface point 43 and the load support assembly 25 is at its lowest position. In this condition the apparatus 10 is placed under a load to be lifted, such as a motorcycle frame and engine. The load support assembly 25 can be raised to the position illustrated in solid lines in FIG. 5 by a person inserting a foot in the space 60 of the handle 56 and stepping downward on the lower arm 58 with sufficient force to rotate the cam 35 clockwise about pin 34. Due to the aforementioned parallelogram lower arm 58 of the handle 56 remains substantially horizontal as the handle 56 is forced downward to the position illustrated in solid lines. As the cam 35 is pivoted above the pin 34 the load support assembly 25 rises with translational movement relative to the base member 16 until the load assembly 25 is in its highest position illustrated in phantom lines above where it is illustrated in solid lines, which correspond to the cam follower 38 being at the third cam surface point 45. As the cam 35 rotation continues clockwise about pin 34 the cam follower 38 reaches the second cam surface point 44 and the load support assembly 25 is held in the intermediate position illustrated in solid lines. If the cam 35 were to continue pivoting in a clockwise direction the cam follower 38 would have to go up a second inclined surface 63 on the cam surface 37. This additional pivoting of the cam 35 in the illustrated embodiment is prevented by the lever 53 stricking the surface 11 before the cam follower 38 can go up the second inclined surface 63. Persons versed in the art will appreciate that mechanical devices such as a mechanical stop connecting the brackets 32–33 can be used to prevent the cam follower 38 traveling on the cam surface 37 beyond the second cam surface point 44. In the embodiment illustraed in FIG. 5 second link 61 and pin 54 serve this function.

When the operator wishes to lower the load support assembly 25 from intermediate position illustrated in FIG. 5 he may do so by putting a foot in space 60 of the handle 56 and raising the foot against the bottom of the upper arm 59 so as to pivot the cam 35 counter-clockwise about pin 34 until the cam follower 38 passes the third cam surface point 45. Once the cam follower 38 is between the first cam surface point 43 and the third cam surface point 45 the weight of the load support assembly 25 and any load that it supports being transmitted through the cam follower 38 to the cam surface 37 produces a horizontal force component tending to pivot cam 35 counter-clockwise about pin 34 so as to return the load support assembly 25 to its lowest position, at which time the cam follower 38 again contacts first cam surface point 43.

It is thus apparent as the cam follower 38 moves on the cam surface 37 it reaches first, second and third positions above surface 11 corresponding to it making contact with the first, second and third cam surface points 43–44 and produces corresponding first, second and third lengths of the telescopic column formed by the base column 18 and the load support column 27.

Persons versed in the art will appreciate the various modifications of the subject apparatus that can be made without departing from the spirit of the invention. For example, instead of utilizing two columns which are fitted one inside of the other the entire apparatus can be placed inside a box having top and bottom sections utilizing pins and guide holes in each corner of the box for purposes of preventing any relative motion between the top and bottom of the box other than translational motion.

Persons versed in the art will also appreciate that sliding movement between respective columns is intended to be generic in term as roller bearings and other such apparatus can be used to prevent actual contact between the columns.

What is claimed is:

1. Apparatus for lifting a load above a surface comprising, in combination, a telescopic column, said column being substantially defined by a vertical longitudinal axis and including upper and lower sections in slidable relation, said lower section including a base for supporting said column on said surface, said upper section including a load support for supporting said load; a cam follower secured to one of said column sections; a cam pivotally secured at a pivot having a substantially horizontal axis to the other of said column sections, said cam having a cam surface in contact with said cam follower so that when said cam is pivoted said cam follower follows said cam surface and said column is telescoped, said cam surface having points which contact said cam follower including first, second and third points, said column having a first length when said cam follower contacts said cam surface first point, said column having a second length longer than said first length when said cam follower contacts said cam surface second point, said column having a third length longer than said second length when said cam follower contacts said cam surface third point, said cam surface third point being between said cam surface first and second points, said cam surface being inclined relative to said pivot between said cam surface second and third points so as to prevent said cam follower moving from said cam surface second point to said cam surface third point without lengthening said column; and actuator means for pivoting said cam about said pivot so as to move said cam surface relative to said cam follower from said cam surface first point to said cam surface second point and back to said cam surface first point whereby said load may be supported by said upper section in a low position above said surface when said cam follower contacts said cam surface first point, in a high position above said surface when said cam follower contacts said cam surface second point, and in a position higher above said surface than said high position when said cam follower contacts said cam surface third point whereby the weight of said load support and of any load on said load support is transmitted through said point where said cam follower contacts said cam surface so that when said cam follower contacts said cam surface at a point between said cam surface second and third points said weight tends to pivot said cam in a first direction about said pivot so as to move said contact point toward said second point and when said cam follower contacts said cam surface at a point between said cam surface first and third points said weight tends to pivot said cam in a second direction opposite said first direction, said actuator means including a handle and first and second links that each have first and second ends, said first link first end being pivotally attached to said other section at said pivot and being rigidly attached to said cam, said second link first end being pivotally attached to said other section at another pivot, said seconds ends of said first and second links each being pivotally attached to said handle whereby lowering said handle toward said surface pivots said cam in said first direction so as to move said cam surface past said cam follower from said cam surface first point toward said cam surface second point and raising said handle above said surface pivots said cam in said second direction so as to move said cam surface past said cam follower from said cam surface second point toward said cam surface first point.

2. Apparatus for lifting a load above a surface comprising, in combination, a telescopic column, said column being substatially defined by a vertical longitudinal axis and including upper and lower sections in slidable relation, said lower section including a base for supporting said column on said surface, said upper section including a load support for supporting said load; a cam follower secured to one of said column sections; a cam pivotally secured at a pivot having a substantially horizontal axis to the other of said column sections, said cam having a cam surface in contact with said cam follower so that when said cam is pivoted said cam follower follows said cam surface and said column is telescoped, said cam surface having points which contact said cam follower including first, second and third points, said column having a first length when said cam follower contacts said cam surface first point, said column having a second length longer than said first length when said cam follower contacts said cam surface second point, said column having a third length longer than said second length when said cam follower contacts said cam surface third point, said cam surface third point being between said cam surface first and second points, said cam surface being inclined relative to said pivot between said cam surface second and third points so as to prevent said cam follower moving from said cam surface second point to said cam surface third point without lengthening said column; and actuator means for pivoting said cam about said pivot so as to move said cam surface relative to said cam follower from said cam surface first point to said cam surface second point and back to said cam surface first point whereby said load may be supported by said upper section in a low position above said surface when said cam follower contacts said cam surface first point, in a high position above said surface when said cam follower contacts said cam surface second point, and in a position higher above said surface than said high position when said cam follower contacts said cam surface third point whereby the weight of said load support and of any load on said load support is transmitted through said point where said cam follower contacts said cam surface so that when said cam follower contacts said cam surface at a point between said cam surface second and third points said weight tends to pivot said cam in a first direction about said pivot so as to move said contact point toward said second point and when said cam follower contacts said cam surface at a point between said cam surface first and third points said weight tends to pivot said cam in a second direction opposite said first direction, said actuator means including a handle and first and second links that each have first and second ends, said first link first end being pivotally attached to said other section at said pivot and being rigidly attached to said cam, said second link first end being pivotally attached to said other section at another pivot, said second ends of said first and second links each being pivotally attached to said handle whereby lowering said handle toward said surface pivots said cam in said first direction so as to move said cam surface past said cam follower from said cam surface first point toward said cam surface second point and raising said handle above said surface pivots said cam in said second direction so as to move said cam surface past said cam follower from said cam surface second point toward said cam surface first point, said handle including a stirrup having an upper arm and a substantially horizontal lower arm between which a human foot may be inserted so said handle may be lowered by pushing down with said foot on said lower arm and said handle may be raised by pushing up with said foot on said uppper arm.

3. Apparatus for lifting a load above a surface comprising, in combination, a base member supported by said surface; a movable member for supporting said load; a cam pivotally attached to said base member said pivot having substantially a horizontal axis, said cam having a predetermined cam surface; a cam follower secured to said movable member and supported by said cam surface on a substantially vertical axis; alignment means for maintaining said movable member in a predetermined alignment with said base member so as to permit relative movement between said members substantially only in the direction of said vertical axis; a lever secured to said cam for pivoting said cam about said pivot so that said cam surface moves said cam follower substantially vertically along said axis, said cam surface having a first point at which said cam follower is supported in a first position above said surface, a second point at which said cam follower is supported in a second position higher above said surface than said first position, and a third point between said first and second points at which said cam follower is supported in a third position higher above said surface than said second position whereby said cam is held in either said first or second position by the weight on said cam follower of said movable member and any load said movable member supports until a sufficient force is applied to said lever so as to pivot said cam until said cam surface is moved past said cam follower from said first or second point past said third point, a link having one end pivotally attached to said base member and a handle pivotally attached both to said lever and to said link so as to substantially form a parallelogram in which said base member and said handle form opposite and substantially parallel sides and said lever and said link form opposite and substantially parallel sides, said pivots each having a substantially horizontal axis, said handle including a stirrup having a substantially horizontal lower arm and an upper arm separated from said lower arm by a space of sufficient size to accept insertion of a human foot whereby said cam may be pivoted in a first direction by a downward force on said lower arm and may be pivoted in a second direction opposite said first direction by an upward force on said upper arm.

4. A stand for raising and lowering a load above a surface comprising, in combination, a base supported by said surface; a support positioned for translational movement relative to said base for raising and supporting said load; a cam pivotally secured to said base at a pivot having a substantially horizontal axis, said cam having a certain cam surface; a lever secured to said cam for rotating said cam about said pivot; a cam follower secured to said support and positioned on a predetermined vertical axis and supported by said cam surface so that said cam follower remains on said axis as said support moves translationally relative to said base; guide means for guiding said support so as to prevent relative motion between said support and said base other than translational movement of said support, said cam surface including first, second and third points at which said cam follower may be supported at first, second and third positions, respectively, above said surface while said cam is pivoted on said pivot so as to move said cam surface past said cam follower, said cam surface third point being between said cam surface first and second points, said second position being higher above said surface than said first position and said third position being higher above said surface than said second position whereby said support is at a lowest position when said cam follower is supported at said cam surface first point, is raised from said lowest position to a highest position by applying a force on said lever so as to pivot said cam in a first direction about said pivot until said cam surface third point supports said cam follower and is lowered to an intermediate position higher than said lowest position by pivoting said cam in said first direction about said pivot until said cam surface second point supports said cam follower and whereby said support is raised from said intermediate position to said highest position by applying a force on said lever so as to pivot said cam in a second direction about said pivot opposite said first direction until said cam surface third point supports said cam follower and is lowered from said highest position to said lowest position by pivoting said cam in said second direction until said cam follower is supported by said cam surface first point, the weight of said support and any load on said support being applied through said cam follower to said cam surface so as to pivot said cam about said pivot in said first direction when said cam follower is on said cam surface at a point between said cam surface second and third points and so as to pivot said cam about said pivot in said second direction when said cam follower is on said cam surface at a point between said cam surface first and third points; a link having one end pivotally connected to said base and a handle pivotally connected to said link and pivotally connected to said lever, each of said pivotal connections having a substantially horizontal axis, whereby said lever and said cam may be pivoted in said first direction by a substantially downward force on said handle and may be pivoted in said second direction by a substantially upward force on said handle.

5. Apparatus for raising and lowering a load above a surface comprising, in combination, a base supported by said surface, said base including a substantially vertical column having a bottom end secured to said base and a free top end; a load support, said load support including a substantially vertical column, said columns each being tubular and having substantially the same cross section configuration, one of said columns having inside dimensions substantially the same and slightly smaller than the outside dimensions of the other column, said column having the smallest cross section dimensions being positioned inside said column having the largest cross section dimensions so that said column may be defined by a single substantially vertical axis and said columns telescope in a slidable relation therebetween so as to permit only translational movement between said base and said load support, each of said columns having vertical notches of a predetermined width on two opposite sides of said columns, said notches being aligned on a substantially horizontal axis; a cam pivotally secured at a pivot to said base and having a width less than said predetermined width, said pivot being defined by a substantially horizontal axis, said cam being positioned so as to extend from said pivot substantially horizontally into said column notches, said cam having a top surface that is a cam surface that includes first and second points and a third point between said cam surface first and second points; a cam follower secured to said load support and positioned inside said load support column so as to be supported by said cam surface, said cam follower being supported by said cam surface at a first position above said surface when said cam follower contacts said cam surface first point, is supported at a second position higher than said first position above said surface when said cam follower contacts said cam surface second point and is supported at a third position higher than said second position when said cam follower contacts said cam surface third point; a lever secured to said cam so as to pivot about said pivot for pivoting said cam in a first direction when said lever is pivoted in said first direction and for pivoting said cam in a second direction opposite said first direction when said lever is pivoted in a said second direction; means for stopping downward movement of said load support along said vertical axis toward said surface when said cam follower is on said cam surface first point whereby said load support is at a lowest position above said surface when said cam follower contacts said cam surface first point and is at an intermediate position higher above said surface when said cam follower contacts said cam surface second point and is at a highest position when said cam follower contacts said cam surface third point and said cam is pivoted about said pivot so as to change the point said cam follower contacts said cam surface between said cam surface first and second points by pivoting said lever in said first and second directions, the weight of said load support and any load on said load support being transmitted through said cam follower to said cam surface so that when said cam follower contacts said cam surface between said cam surface first and third points said weight tends to pivot said cam in said second direction and when said cam follower contacts said cam surface between said cam surface second and third points said weight tends to pivot said cam in said first direction; a handle and a link, one end of said link being pivotally connected to said base and another end of said link being pivotally connected to said handle, said handle also being pivotally connected to said lever so as to substantially form a parallelogram substantially defined by a vertical plane with upper and lower sides comprised of said link and said lever connected at each end by said base and said handle, said handle including a stirrup comprised of a substantially horizontal lower arm and an upper arm above said lower arm whereby said lever may be pivoted in said first direction by a downward force on said handle and may be pivoted in said second direction by an upward force on said handle.

6. Apparatus for raising and lowering a load above a surface comprising, in combination, a base supported by said surface, said base including a substantially vertical column having a bottom end secured to said base and a free top end; a load support, said load support including a substantially vertical column, said columns each being tubular and having substantially the same cross section configuration, one of said columns having inside dimensions substantially the same and slightly smaller than the outside dimensions of the other column, said column having the smallest cross section dimensions being positioned inside said column having the largest cross section dimensions so that said column may be defined by a single substantially vertical axis and said columns telescope in a slidable relation therebetween so as to permit only translational movement between said base and said load support, each of said columns having vertical notches of a predetermined width on two opposite sides of said columns, said notches being aligned on a substantially horizontal axis; a cam pivotally secured at a pivot to said base and having a width less than said predetermined width, said pivot being defined by a substantially horizontal axis, said cam being positioned so as to extend from said pivot substantially horizontally into said column notches, said cam having a top surface that is a cam surface that includes first and second points and a third point between said cam surface first and second points; a cam follower secured to said load support and positioned inside said load support column so as to be supported by said cam surface, said cam follower being supported by said cam surface at a first position above said surface when said cam follower contacts said cam surface first point, is supported at a second position higher than said first position above said surface when said cam follower contacts said cam surface second point and is supported at a third position higher than said second position when said cam follower contacts said cam surface third point, said cam follower being a pulley having a grooved rim, said groove having a width wider than said cam width whereby said pulley straddles said cam surface; a lever secured to said cam so as to pivot about said pivot for pivoting said cam in a first direction when said lever is pivoted in said first direction and for pivoting said cam in a second direction opposite said first direction when said lever is pivoted in a said second direction; means for stopping downward movement of said load support along said vertical axis toward said surface when said cam follower is on said cam surface first point whereby said load support is at a lowest position above said surface when said cam follower contacts said cam surface first point and is at an intermediate position higher above said surface when said cam follower contacts said cam surface second point and is at a highest position when said cam follower contacts said cam surface third point and said cam is pivoted about said pivot so as to change the point said cam follower contacts said cam surface between said cam surface first and second points by pivoting said lever in said first and second directions, the weight of said load support and any load on said load support being transmitted through said cam follower to said cam surface so that when said cam follower contacts said cam surface between said cam surface first and third points said weight tends to pivot said cam in said second direction and when said cam follower contacts said cam surface between said cam surface second and third points said weight tends to pivot said cam in said first direction.

* * * * *

UNITED STATES PATENT AND TRADEMARK OFFICE

CERTIFICATE OF CORRECTION

PATENT NO. : 4,457,492

DATED : July 3, 1984

INVENTOR(S) : Terry L. Lahti

It is certified that error appears in the above-identified patent and that said Letters Patent is hereby corrected as shown below:

Column 3, Line 46, "inn" should be --in--.

Column 4, Line 67, "of" should be --or--.

Column 5, Line 67, "above" should be --about--.

Column 7, Line 49, "seconds" should be --second--.

Signed and Sealed this

*Thirtieth* Day of *October 1984*

[SEAL]

*Attest:*

GERALD J. MOSSINGHOFF

*Attesting Officer*

*Commissioner of Patents and Trademarks*